US008006808B2

(12) United States Patent
Piedra et al.

(10) Patent No.: US 8,006,808 B2
(45) Date of Patent: Aug. 30, 2011

(54) MANAGING AN ENCODER MALFUNCTION IN AN ELEVATOR DRIVE SYSTEM

(75) Inventors: Edward D. Piedra, Holyoke, MA (US); Jeffrey M. Izard, Bolton, CT (US); Ismail Agirman, Southington, CT (US)

(73) Assignee: Otis Elevator Company, Farmington, CT (US)

( * ) Notice: Subject to any disclaimer, the term of this patent is extended or adjusted under 35 U.S.C. 154(b) by 621 days.

(21) Appl. No.: 12/087,694

(22) PCT Filed: Jan. 30, 2006

(86) PCT No.: PCT/US2006/003223

§ 371 (c)(1),
(2), (4) Date: Jul. 11, 2008

(87) PCT Pub. No.: WO2007/086872

PCT Pub. Date: Aug. 2, 2007

(65) Prior Publication Data

US 2009/0000877 A1 Jan. 1, 2009

(51) Int. Cl.
*B66B 1/34* (2006.01)

(52) U.S. Cl. ..... 187/393; 187/286

(58) Field of Classification Search ..... 187/277, 187/286, 293, 305, 391–393
See application file for complete search history.

(56) References Cited

U.S. PATENT DOCUMENTS

| | | | | |
|---|---|---|---|---|
| 4,898,263 | A | 2/1990 | Manske et al. | |
| 5,631,452 | A | 5/1997 | Jamieson et al. | |
| 5,900,596 | A | 5/1999 | Koshak et al. | |
| 6,330,936 | B1 * | 12/2001 | Lence Barreiro et al. | 187/393 |
| 6,392,537 | B1 | 5/2002 | Tazumi et al. | |
| 6,397,974 | B1 | 6/2002 | Adifon et al. | |
| 6,401,875 | B1 | 6/2002 | Marvin et al. | |
| 6,484,125 | B1 * | 11/2002 | Huang et al. | 702/183 |
| 6,492,788 | B1 | 12/2002 | Agirman et al. | |
| 6,604,611 | B2 * | 8/2003 | Liu et al. | 187/391 |
| 6,683,432 | B2 * | 1/2004 | Griffis | 318/568.16 |
| 7,482,771 | B2 * | 1/2009 | Hahn et al. | 318/272 |
| 7,721,852 | B2 * | 5/2010 | Ishioka et al. | 187/391 |

* cited by examiner

*Primary Examiner* — Anthony Salata
(74) *Attorney, Agent, or Firm* — Kinney & Lange, P.A.

(57) ABSTRACT

An encoder failure in an elevator drive system is detected and managed. A velocity of the elevator drive system is provided by an encoder signal (60) and compared with a minimum velocity threshold (62). An encoder fault timer is incremented when the velocity is less than the minimum velocity threshold (64). The elevator drive system is disabled when the encoder fault timer reaches a fault threshold time (66).

23 Claims, 2 Drawing Sheets

MANAGING AN ENCODER MALFUNCTION IN AN ELEVATOR DRIVE SYSTEM

BACKGROUND OF THE INVENTION

The present invention relates to elevators and elevator systems. In particular, the present invention relates to managing an encoder failure in an elevator drive system.

Elevator systems utilizing synchronous motor elevator machines need to detect absolute angular rotor position relative to the stator pole windings to be able to achieve maximum torque. An encoder, such as an incremental encoder, may be connected to the motor to track the position of the magnet in the rotor and provide a feedback signal indicative of the position and velocity to a signal processor in the elevator system. If the feedback signal from the encoder is lost (e.g., due to a power failure), the position of the rotor is no longer known to the elevator drive system. Because this limits the control that the elevator drive system has over the motor, the elevator brake is engaged to hold the elevator car in position, and the drive is disabled. However, the time between the loss of the encoder feedback signal and detection of this condition can be substantial, resulting in uncontrolled motion of the elevator car of up to two meters.

BRIEF SUMMARY OF THE INVENTION

The subject invention is directed to detecting and managing an encoder failure in an elevator drive system. A velocity of the elevator drive system is provided by an encoder signal and compared with a minimum velocity threshold. An encoder fault timer is incremented when the velocity is less than the minimum velocity threshold. The elevator drive system is disabled when the encoder fault timer reaches a fault threshold time.

DETAILED DESCRIPTION

Figure 1:
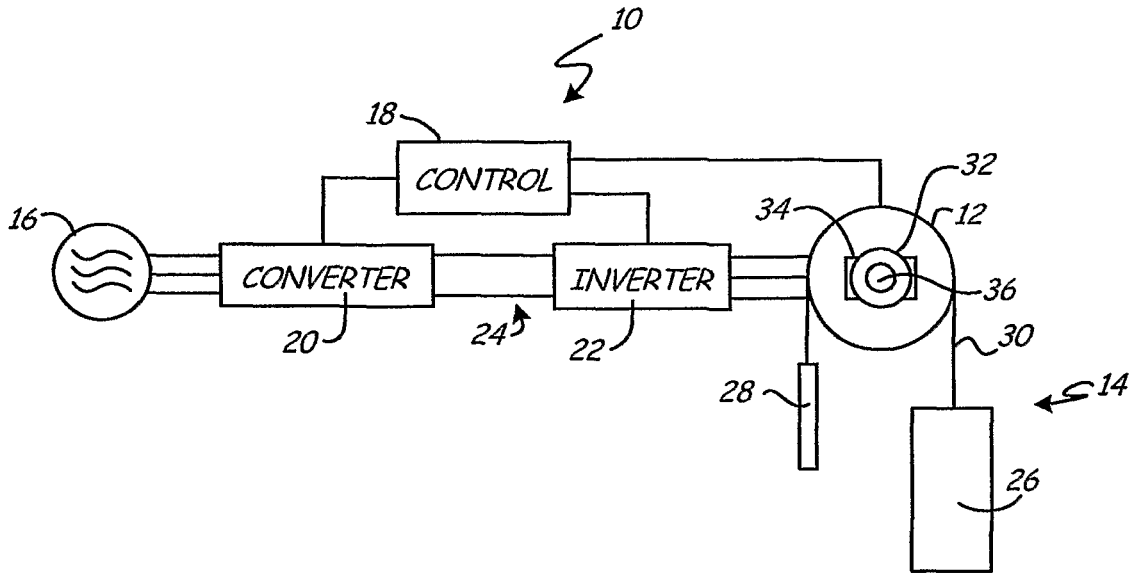
FIG. 1 is a schematic view of an elevator drive system including an encoder operatively connected to an elevator hoist motor.

FIG. 1 is a schematic view of elevator drive system 10 for driving hoist motor 12 of elevator 14 from AC power line 16, which may be connected to an electrical utility, such as from a commercial power source. Elevator drive system 10 includes controller 18, converter 20, and inverter 22. DC bus 24 connects converter 20 and inverter 22. Elevator 14 includes elevator car 26 and counterweight 28 that are connected through rope 30 across sheave 32. Brake 34 engages sheave 32 to prevent motion of elevator car 26 and counterweight 28. Encoder 36 is mounted coaxially with sheave 32. Controller 18 is connected to converter 20, inverter 22, and encoder 36.

Power line 16 provides three-phase AC power to converter 20. Converter 20 is a three-phase power converter that is operable to convert three-phase AC power from power supply 16 to DC power and provide the DC power to DC bus 24. In addition, converter 20 is operable to invert power on DC bus 24 to be returned to power supply 16. It should be noted that while power supply 16 is shown as a three-phase AC power supply, elevator drive system 10 may be adapted to receive power from any type of power source, including a single phase AC power source and a DC power source.

Inverter 22 is a three-phase power inverter that is operable to invert DC power from DC bus 24 to three-phase AC power. The three-phase AC power at the outputs of inverter 22 is provided to hoist motor 12. In addition, inverter 22 is operable to rectify power from hoist motor 12 to DC bus 24 that is generated when elevator 14 drives hoist motor 12.

Elevator 14 includes elevator car 26 and counterweight 28 that are connected through rope 30 to move concurrently and in opposite directions within an elevator hoistway. Counterweight 28 balances the load of elevator car 26 and facilitates movement of elevator car 26. Hoist motor 12 drives sheave 32 to produce linear movement of elevator car 12 and counterweight 14. Motor 12 drives sheave 32 based on drive signals received from inverter 22 as controlled by controller 18. The magnitude and direction of force (i.e., torque) provided by motor 12 on rope 30 controls the speed and direction of elevator car 26, as well as the acceleration and deceleration of elevator car 26. Encoder 36 is connected coaxially with sheave 32 to provide signals to controller 18 related to the direction of motion, speed, and acceleration of, and the distance traveled by, elevator car 26.

Figure 2:
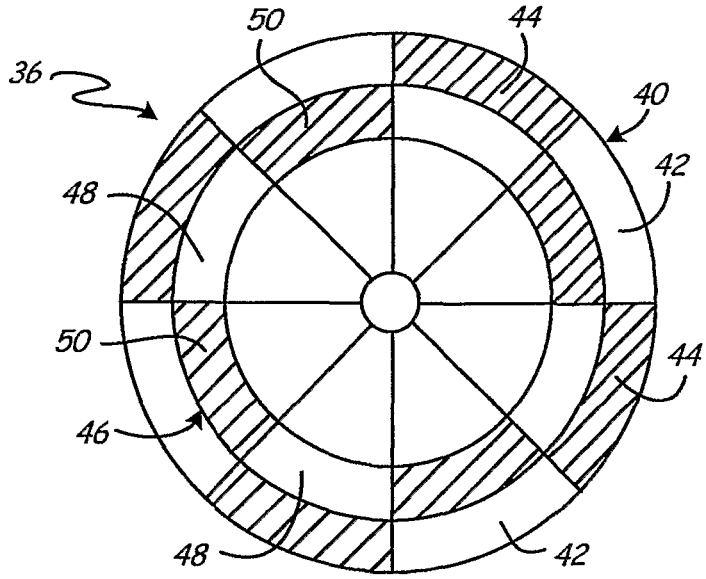
FIG. 2 is a functional diagram of an example incremental encoder for use in conjunction with the elevator power system shown in FIG. 1.

FIG. 2 is a functional diagram of an example encoder 36 for use in conjunction with elevator drive system 10. Encoder 36 includes an outer track 40 of equally sized openings 42 spaced apart by equally sized masked regions 44. Encoder 36 also includes inner track 46 of alternating openings 48 and masked regions 50. Openings 42 and 48 have substantially similar angular areas as masked regions 44 and 50, respectively. Masked regions 50 of inner track 48 are offset from openings 42 of outer track 40.

Encoder 36 includes a light source and a light detector (not shown) associated with each of outer track 40 and inner track 46. The light source and light detector are disposed on opposite sides of the encoder track such that electrical signals are produced by the light detector when encoder 36 rotates through and chops the light beam from the light source. These signals are provided by the light detectors for outer track 40 and inner track 46 to controller 18 to provide motion feedback regarding elevator car 26. More specifically, the amount of rotation by encoder 36 may be determined by counting the number of signal pulses generated by the light detector. This can then be converted to determine the linear distance traveled by elevator car 26. In addition, the order in which the electrical signals are received from the light detectors can be used to determine the direction of motion of elevator car 26. Furthermore, the rate at which the signals from the light detectors are received can be converted to determine the speed and acceleration of elevator car 26. It should be noted that encoder 36 shown in FIG. 2 is merely illustrative, and many types of encoders capable of providing signals related to the motion of elevator 14 may be used in conjunction with elevator power system 10.

The motion information provided by encoder 36 to controller 18 is used in driving hoist motor 12. That is, controller 18 compares the velocity and motion feedback provided by the signals from encoder 36 to a commanded velocity and direction of motion for elevator 14. The commanded velocity and direction of motion for elevator 14 is based on efficient dispatching of elevator car 26 based on elevator demands. Controller 18 then operates inverter 22 to drive hoist motor 12 such that the actual velocity and direction of motion of elevator 14 matches the commanded velocity and direction of motion.

If encoder 36 fails, such as due to a power failure or a component failure, the velocity feedback provided by encoder 36 drops to zero or close to zero. When this occurs, uncontrolled or unintended motion of elevator car 26 may occur. For example, in a permanent magnet hoist motor, the position of the north pole magnet position (which is provided by the encoder signal) needs to be known to properly control hoist motor 12 and elevator car 26. If the signal from encoder 36 is lost, elevator drive system 10 may temporarily lose control of hoist motor 12 until motion of elevator car 26 is detected and brake 34 is engaged to prevent motion of sheave 32. The magnitude of the uncontrolled motion may be two meters or more before brake 34 is engaged.

Figure 3:
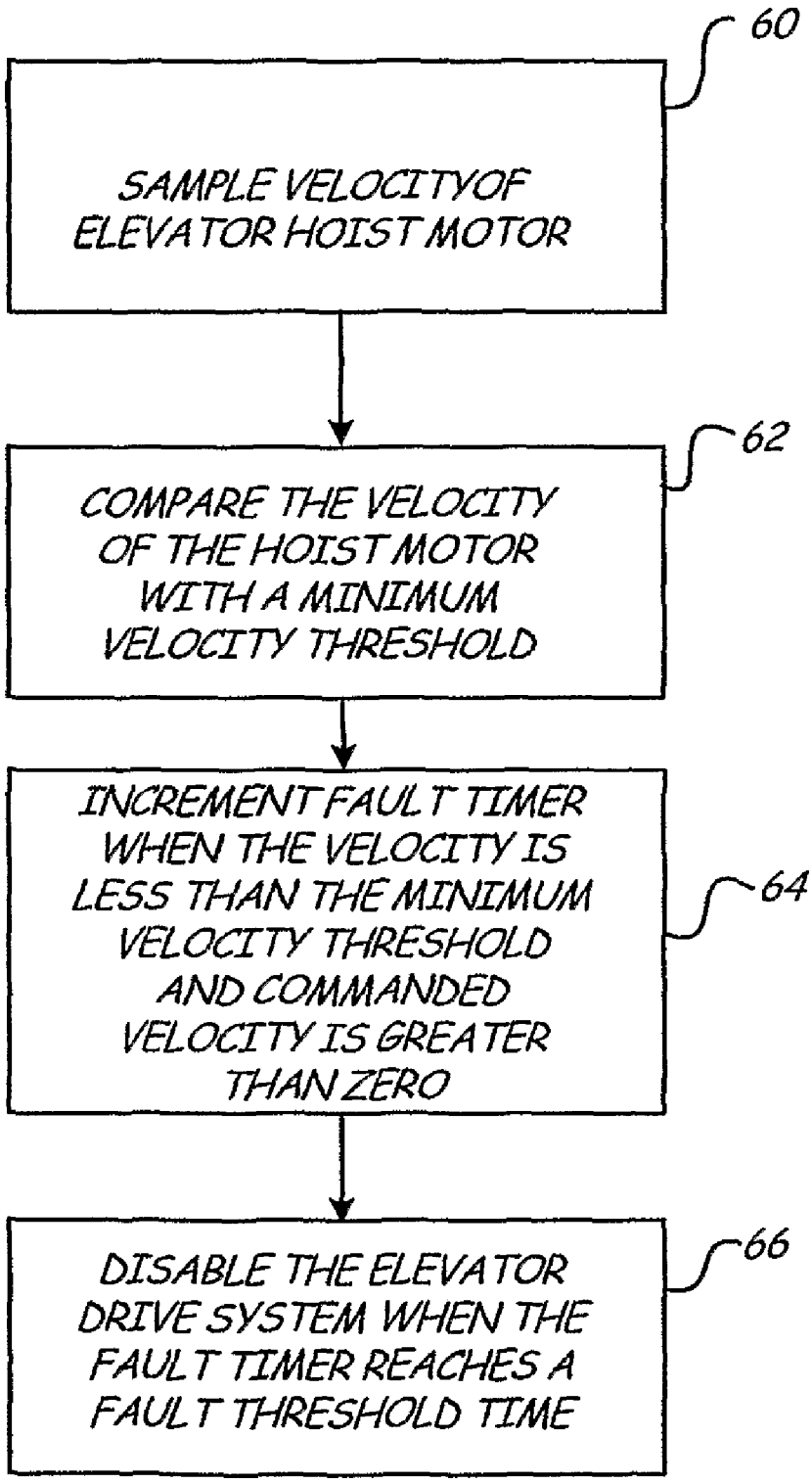
FIG. 3 is a flow diagram for a process of managing an encoder malfunction according to the present invention.

FIG. 3 is a flow diagram for a process of managing a malfunction of encoder 36 according to the present invention. Controller 18 processes the feedback signal provided by encoder 36 to sample the velocity of hoist motor 12 (step 60). If the commanded velocity is greater than zero, but the velocity feedback from encoder 36 is less than a minimum velocity threshold (step 62), a fault bit is set in controller 18. In one embodiment, the minimum threshold velocity is about 1 mm/s. If the velocity feedback from encoder 36 is greater than or equal to the minimum velocity threshold, the fault bit is cleared.

Controller 18 samples the fault bit periodically (e.g., every 10 ms) and increments a fault timer if the fault bit is set (step 64). If the fault bit is cleared when controller 18 samples the fault bit, the fault timer is cleared. If the fault bit is set for a fault threshold period of time (e.g., 300 ms), controller 18 immediately disables inverter 22 and engages brake 34 to prevent unintended motion of elevator car 26 (step 66). The present invention is useful for detecting and minimizing unintended motion of elevator car 26 at normal speed elevator runs, as well as low and high speed elevator runs.

The fault threshold time is set low enough to quickly detect the malfunction of encoder 36 to minimize unintended motion of elevator car 14. In this way, the unintended motion of elevator car 14 can be limited to about 2 or 3 cm before brake 34 is engaged. In addition, the fault threshold period of time is set high enough to prevent nuisance fault events. For example, for a motionless elevator, the velocity feedback from encoder 36 becomes greater than 1 mm/s about 200 ms after the commanded velocity becomes non-zero. Thus, by setting the fault threshold period of time at 300 ms, nuisance faults that may be caused when elevator 14 is put into motion are avoided.

In addition, in the event of a failure of encoder 36, the position of hoist motor 12 may no longer be known. For example, in a permanent magnet motor the position of the north pole magnet may not be known. If the fault threshold time is reached, controller 18 may set an attribute related to the position of the magnet in motor 14 being unknown. When operation of encoder 36 is reestablished, controller 18 may then immediately determine the position of hoist motor 12 to ensure proper control over elevator 14 when brake 34 is disengaged.

In summary, the present invention is directed to detecting and managing an encoder failure in an elevator drive system. A velocity of the elevator drive system is provided by an encoder signal and compared with a minimum velocity threshold. An encoder fault timer is incremented when the velocity is less than the minimum velocity threshold. The elevator drive system is disabled when the encoder fault timer reaches a fault threshold time. The fault threshold time is set high enough to prevent nuisance fault events, but low enough to quickly detect the encoder failure to minimize unintended motion of the elevator car.

Although the present invention has been described with reference to examples and preferred embodiments, workers skilled in the art will recognize that changes may be made in form and detail without departing from the spirit and scope of the invention.

The invention claimed is:

1. A method for detecting and managing an encoder failure in an elevator drive system, the method comprising:
- providing an encoder signal related to a velocity of the elevator drive system;
- comparing the sensed velocity with a minimum velocity threshold;
- incrementing an encoder fault timer when the sensed velocity is less than the minimum velocity threshold; and
- disabling the elevator drive system substantially immediately after the encoder fault timer reaches a fault threshold time.

2. The method of claim 1, wherein disabling the elevator drive system comprises disabling a drive inverter in the elevator drive system.

3. The method of claim 1, wherein disabling the elevator drive system comprises engaging a brake to prevent motion of a drive sheave in the elevator drive system.

4. The method of claim 1, wherein the minimum velocity threshold is about one millimeter per second.

5. The method of claim 1, wherein the fault threshold time is about 300 milliseconds.

6. The method of claim 1, wherein the comparing step comprises:
- setting a fault bit in an elevator drive processor when the sensed velocity is less than the minimum velocity threshold; and
- clearing the fault bit in the elevator drive processor when the sensed velocity is at least the minimum velocity threshold.

7. The method of claim 6, wherein the incrementing step comprises incrementing the encoder fault timer when the fault bit is set.

8. The method of claim 6, and further comprising:
- resetting the encoder fault timer when the sensed velocity is at least the minimum velocity threshold.

9. A method for controlling an elevator drive system, the method comprising:
- monitoring a velocity of the elevator drive system;
- disabling a drive inverter in the elevator drive system substantially immediately after the velocity remains below a velocity threshold for a fault threshold time; and
- engaging a sheave brake to prevent motion of a drive sheave in the elevator drive system.

10. The method of claim 9, wherein the monitoring step comprises:
- sensing velocity of the elevator drive system;
- comparing the velocity with the velocity threshold; and
- incrementing an encoder fault timer when the velocity is less than the velocity threshold.

11. The method of claim 10, wherein the comparing step comprises:
- setting a fault bit in an elevator drive processor when the velocity is less than the velocity threshold; and
- clearing the fault bit in the elevator drive processor when the velocity is at least the velocity threshold.

12. The method of claim 11, wherein the incrementing step comprises incrementing the encoder fault timer when the fault bit is set.

13. The method of claim 10, and further comprising:

resetting the encoder fault timer when the velocity is at least the velocity threshold.

14. The method of claim 9, wherein the velocity threshold is about one millimeter per second.

15. The method of claim 9, wherein the fault threshold time is about 300 milliseconds.

16. A system comprising:

an elevator hoist machine including a motor, a rotating member driven by the motor for actuating a rope that connects an elevator car and a counterweight, and a brake for preventing the rotating member from rotating;

an encoder operatively connected to the motor for providing a signal related to a position and velocity of the motor; and a drive controller for receiving the signal from the encoder and disabling the motor and engaging the brake substantially immediately after the velocity of the motor remains below a velocity threshold for a fault threshold time.

17. The system of claim 16, wherein the drive controller increments an encoder fault timer when the velocity of the motor is less than the velocity threshold and resets the encoder fault timer when the velocity is at least the velocity threshold.

18. The system of claim 17, wherein the drive controller includes a register in which a fault bit is set when the velocity of the motor is less than the velocity threshold and the fault bit is cleared when the velocity of the motor is at least the velocity threshold.

19. The system of claim 18, wherein the drive controller increments the encoder fault timer when the fault bit is set and resets the encoder fault timer when the fault bit is cleared.

20. The system of claim 16, wherein the velocity threshold is about one millimeter per second.

21. A system comprising:

an elevator hoist machine including a motor, a rotating member driven by the motor for actuating a rope that connects an elevator car and a counterweight, and a brake for preventing the rotating member from rotating;

an encoder operatively connected to the motor for providing a signal related to a position and velocity of the motor; and a drive controller for receiving the signal from the encoder, controlling the motor as a function of a commanded speed and the signal from the encoder, and disabling the motor and engaging the brake after the velocity of the motor indicated by the signal from the encoder remains below a velocity threshold for a fault threshold time while the commanded speed is greater than zero.

22. The system of claim 21, wherein the drive controller increments an encoder fault time when the commanded velocity is greater than zero and the velocity of the motor indicated by the signal from the encoder is less than the velocity threshold, and resets the encoder fault timer when the commanded velocity is greater than zero and the velocity of the motor indicated by the signal from the encoder is at least the velocity threshold.

23. The system of claim 22, wherein the drive controller includes a register in which a fault bit is set when the velocity of the motor indicated by the signal from the encoder is less than the velocity threshold and the commanded velocity is greater than zero, and the fault bit is cleared when the velocity of the motor indicated by the signal from the encoder is at least the velocity threshold and the commanded velocity is greater than zero.

* * * * *